US008529103B2

(12) United States Patent
Tukker et al.

(10) Patent No.: US 8,529,103 B2
(45) Date of Patent: Sep. 10, 2013

(54) ILLUMINATION SYSTEM FOR SPOT ILLUMINATION

(75) Inventors: Teunis Willem Tukker, Eindhoven (NL); Erik Boonekamp, Utrecht (NL); Ralph Kurt, Eindhoven (NL); Mark Eduard Johan Sipkes, Waalre (NL)

(73) Assignee: Koninklijke Philips N. V., Eindhoven (NL)

( * ) Notice: Subject to any disclaimer, the term of this patent is extended or adjusted under 35 U.S.C. 154(b) by 0 days.

(21) Appl. No.: 13/378,411

(22) PCT Filed: Jun. 14, 2010

(86) PCT No.: PCT/IB2010/052628

§ 371 (c)(1), (2), (4) Date: Dec. 15, 2011

(87) PCT Pub. No.: WO2010/146516

PCT Pub. Date: Dec. 23, 2010

(65) Prior Publication Data

US 2012/0087117 A1 Apr. 12, 2012

(30) Foreign Application Priority Data

Jun. 16, 2009 (EP) ..... 09162821

(51) Int. Cl.
*F21V 7/00* (2006.01)

(52) U.S. Cl.
USPC ..... 362/307; 362/327

(58) Field of Classification Search
USPC ..... 362/307, 300, 327, 310, 311.01
See application file for complete search history.

(56) References Cited

U.S. PATENT DOCUMENTS

| | | | | |
|---|---|---|---|---|
| 6,200,002 | B1 | 3/2001 | Marshall et al. | |
| 7,144,131 | B2 | 12/2006 | Rains | |
| 7,490,953 | B2 | 2/2009 | Holten et al. | |
| 2007/0051960 | A1 | 3/2007 | Yu | |
| 2007/0291491 | A1 * | 12/2007 | Li et al. | 362/307 |

FOREIGN PATENT DOCUMENTS

| | | | |
|---|---|---|---|
| CN | 201368347 | Y | 12/2009 |
| EP | 1693615 | A1 | 8/2006 |
| EP | 2233819 | A1 | 9/2010 |
| WO | 2008070981 | A1 | 6/2008 |

* cited by examiner

*Primary Examiner* — Anne Hines
(74) *Attorney, Agent, or Firm* — John F. Salazar; Mark L. Beloborodov

(57) ABSTRACT

An illumination system (10) for spot illumination comprising a tubular reflector (2) with a reflective inner surface, the tubular reflector (2) having an entrance aperture (7) and an exit aperture (8) being larger than the entrance aperture (7); a light-source array (1) comprising a plurality of light-sources (13*a-c;* 30*a-d,* 31*a-d,* 32*a-d*) arranged to emit light into the tubular reflector (2) at the entrance aperture thereof; and a light-diffusing optical member (9) arranged to diffuse light emitted by the illumination system (10). The light-diffusing member (9) is configured to exhibit an increasing diffusing capability with increasing distance from an optic axis (12) of the illumination system.

12 Claims, 3 Drawing Sheets

ILLUMINATION SYSTEM FOR SPOT ILLUMINATION

TECHNICAL FIELD

The present invention relates to an illumination system for spot illumination, comprising a tubular reflector and a light source array.

BACKGROUND OF THE INVENTION

In spot illumination applications, such as scene setting or other atmosphere creating lighting, white light sources with colored filters has been used to a great extent. Lately, as an alternative, illumination systems with colored light sources, such as light emitting diodes, LEDs, have been developed. In systems with colored light sources, the color can be changed by electronic control, and all accessible colors are always available.

In spot illumination applications, the homogeneity of the emitted light is of great importance.

One example of an illumination system for spot illumination is described in U.S. Pat. No. 6,200,002, wherein a tubular collimator collimates light from a light source array arranged in the collimator entrance. Although U.S. Pat. No. 6,200,002 provides for an improved homogeneity compared to the prior art, further improved homogeneity of the emitted light would be desirable.

SUMMARY OF THE INVENTION

In view of the above, a general object of the present invention is to provide an improved illumination system for spot illumination providing for an improved homogeneity of the light emitted by the illumination system.

According to a first aspect of the invention, there is provided an illumination system for spot illumination comprising: a tubular reflector with a reflective inner surface, the tubular reflector having an entrance aperture and an exit aperture being larger than the entrance aperture; a light-source array comprising a plurality of light-sources arranged to emit light into the tubular reflector at the entrance aperture thereof; and a light-diffusing optical member arranged to diffuse light emitted by the illumination system, wherein the light-diffusing member is configured to exhibit an increasing diffusing capability with increasing distance from an optic axis of the illumination system.

The present invention is based on the realization that the light output by an illumination system with a tubular reflector having a larger exit aperture than entrance aperture generally exhibits a higher homogeneity, that is, a higher degree of spatial uniformity, close to the optic axis of the illumination system than further away from the optic axis of the illumination system. The present inventors have further realized that a favorable trade-off between output efficiency of the illumination system and homogeneity of the light output by the illumination system can be achieved by arranging a light-diffusing optical member to diffuse the light output by the illumination system and to configure the light-diffusing optical member to exhibit an increasing diffusing capability with increasing distance from the optic axis of the illumination system.

Hereby, the optical diffusion is concentrated to where it has the greatest effect, whereby an improved homogeneity of the light output by the illumination system can be achieved while minimizing the reduction in optical output efficiency resulting from scattering and/or absorption by the light-diffusing optical member.

The light-diffusing optical member may advantageously diffuse the light incident thereon through scattering, with an increased scattering with increasing distance from the optic axis of the illumination system.

To provide for a sufficient degree of intensity and, when applicable, color uniformity, while keeping down the loss of light in the light-diffusing optical member, the light-diffusing optical member may scatter the incident light by up to about ±10°, depending on the properties of the light-source array and the tubular reflector. For illumination systems in which the light-source array and/or the tubular reflector are/is configured so as to provide for a good mixing of the light, a maximum scattering of about ±5° may be sufficient.

The maximum scattering may advantageously occur close to the rim of the tubular reflector, and a substantially lower level of scattering may be sufficient close to the optic axis. For example, the scattering at the optic axis may be ±1° or even 0°.

The increase in diffusing capability with increasing distance from the optic axis may be substantially continuous or occur in a step-wise fashion.

Furthermore, the light-diffusing member may comprise a device having controllable diffusing properties. One example of such devices is a switchable PDLC layer.

Moreover, the illumination system may advantageously further comprise a focusing optical element arranged to focus light emitted by the illumination system, whereby the angular spread of the light output by the illumination system can be reduced. This may be particularly advantageous in various embodiments of the illumination system according to the present invention, since the light-diffusing optical member may generally increase the angular spread of the light passing through the light-diffusing optical member.

According to various embodiments of the present invention, at least one of the tubular reflector and the light-source array may be configured in such a way that each symmetry state of the light-source array is different from any symmetry state of the tubular reflector.

By "symmetry state" should, in the context of the present application, be understood a state, different from an initial state, resulting in the same configuration as the initial state. A symmetry state may be achieved through any kind of transformation, such as rotation, translation, mirroring etc.

By avoiding coinciding symmetry states, the occurrence of preferred directions of the emitted light can be reduced, whereby the spatial homogeneity with respect to intensity and, where applicable, color of the emitted light can be improved.

The symmetry states, if any, of the tubular reflector can be controlled through, for example, the physical configuration of the tubular reflector, and the symmetry states, if any, of the light-source array may be controlled through the arrangement of the light-sources comprised in the light-source array.

According to various embodiments, non-coinciding symmetry states of the light-source array and the tubular reflector may be achieved by configuring at least one of the tubular reflector and the light-source array such that it has no symmetry states. For example, the light-sources may be arranged at random, and/or the tubular reflector may have an irregular cross-section.

Alternatively, the tubular reflector may exhibit a first number of states having identical configurations, and the light-source array may exhibit a second number of states having identical configurations, and a ratio between the first number and the second number may be a non-integer. Such a configuration provides for non-coinciding symmetry states.

The number of states having identical configurations equals the initial state plus the number of symmetry states, that is, the number of symmetry states plus one.

By, furthermore, configuring the illumination system in such a way that a largest common divisor of the first number and the second number equals one, the occurrence of preferred directions of the emitted light can be even further reduced, whereby homogeneity of the emitted light can be even further improved.

Moreover, the first number, that is, the number of symmetry states exhibited by the tubular reflector may be a prime number that is greater than two, whereby the more design freedom for the arrangement of the light-sources in the light-source array can be achieved, since fewer light-source configurations will exhibit coinciding symmetry states with such a tubular reflector configuration.

According to various embodiments, furthermore, at least one of the tubular reflector and the light-source array may exhibit rotational symmetry with respect to an optic axis of the illumination system.

The tubular reflector may have an essentially polygonal cross-section.

By "polygonal cross-section" should, in the context of the present application, be understood a cross-section that is bounded by a closed path of lines connected at at least three points, forming the corners of the polygonal cross-section. The lines can be straight or curved. For example, each path between the corners of the polygon may be concave or convex with respect to the polygonal cross-section. According to a preferred embodiment the polygonal cross section may be septagonal (7 sides) or enneagonal (9 sides).

According to another embodiment the cross section of the tubular reflector may have an essentially circular or elliptical shape.

To further improve the homogeneity of the light emitted by the illumination system, the illumination system may be configured in such a way that the total area of the light-sources comprised in the light-source array may be equal to at least 5% of an area of the entrance aperture of the tubular reflector.

By the total area of the light-sources should be understood the total emissive surface of the light-source, that is, the area that can emit light.

Through the provision of a sufficient ratio between the total emissive area and the area of the entrance aperture, the homogeneity of the light emitted by the illumination system can be improved further. Tests performed by the present inventors have indicated that such a sufficient ratio is around 5% of the area of the entrance aperture of the tubular reflector, and that an even higher ratio yields an even better result. However, the ratio may be preferably equal or at least 10% more preferably equal or at least 15%, and most preferably equal or at least 20%.

According to various embodiments of the present invention, the light-source array may, furthermore, comprise at least one set of light-sources configured to emit light of a first color and at least one set of light-sources configured to emit light of a second color different from the first color.

A set of light-sources may be a single light-source, or may be a group of light-sources arranged together. For example, a set of light-sources may be provided in the form of a line of light-emitting diodes (LEDs).

Hereby, a color controllable output of light from the illumination system can be provided for.

The present inventors have found that configuring the light-source array in such a way that it comprises at least three sets of light-sources configured to emit light of the first color and at least three sets of light-sources configured to emit light of the second color, is beneficial to the homogeneity of the light output by the illumination system.

Moreover, the light-sources may advantageously be arranged in such a way that the largest spacing between adjacent sets of light-sources is smaller than a third of a lateral extension of the entrance aperture. Hereby, large "dark" areas in the light-source array are avoided, which further improves the homogeneity of the light output by the illumination system. Distributing the light-sources even more uniformly in the light-source array results in a further improvement in the homogeneity.

BRIEF DESCRIPTION OF THE DRAWINGS

These and other aspects of the present invention will now be described in more detail, with reference to the appended drawings showing an exemplary embodiment of the invention, wherein.

DETAILED DESCRIPTION OF AN EMBODIMENT OF THE INVENTION

In the following description, the present invention is described with reference to an illumination system comprising a light-source array exhibiting a first number of symmetry states and a tubular reflector exhibiting a second number of symmetry states.

It should be noted that this by no means limits the scope of the invention, which is equally applicable to other illumination systems, in which one or both of the light-source array and the tubular reflector may lack symmetry states.

Figure 1:
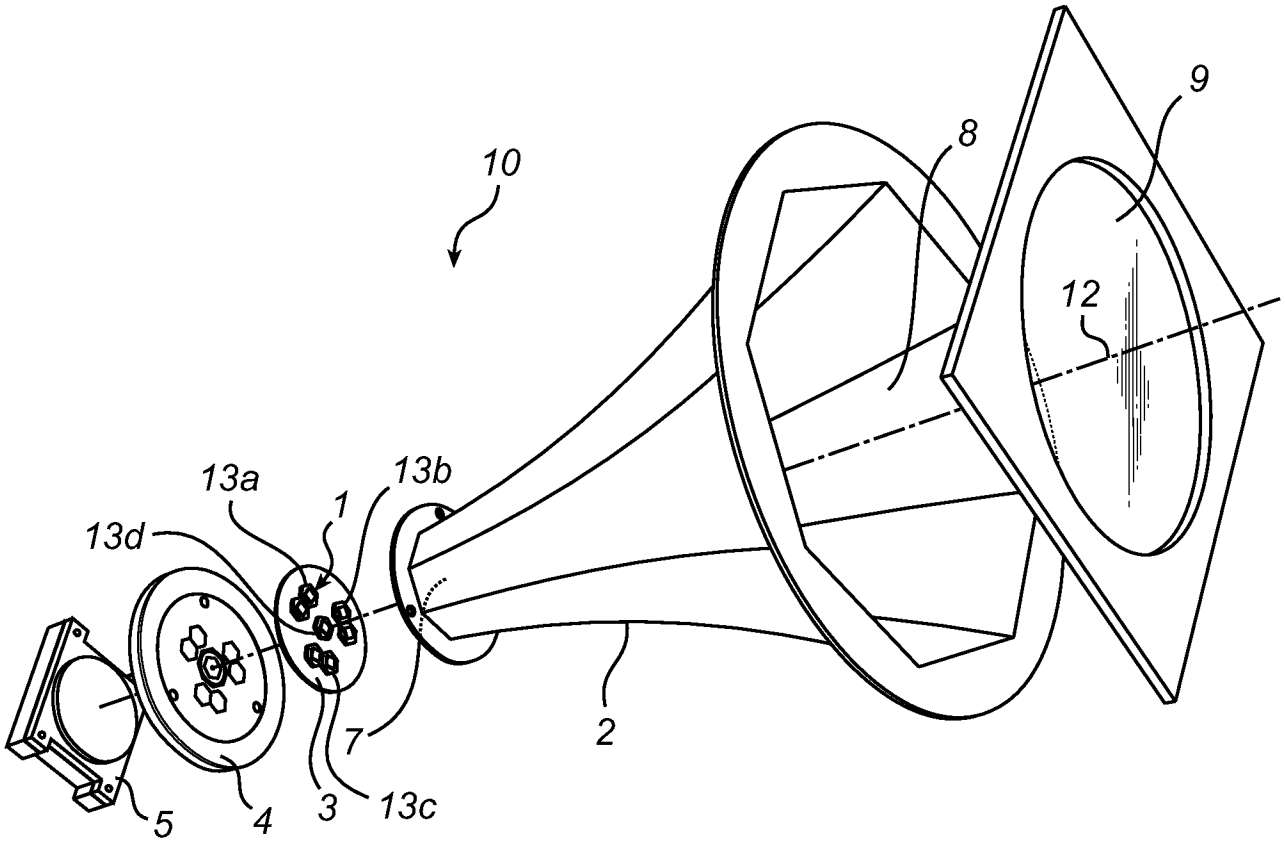
FIG. 1 is an exploded view of an illumination system according to an embodiment of the present invention.

FIG. 1 schematically illustrates an illumination system for spot illumination suitable for atmosphere creating lighting, such as scene setting. The illumination system 10 comprises a light source array 1 formed by light sources 13*a-d*, such as LED arrays, mounted on a carrier, such as a printed circuit board (PCB) 3, which is arranged on a heat spreader 4, which is in turn arranged on a heat sink 5. The illumination system 10 further comprises a tubular reflector 2 with a reflective inner surface. The tubular reflector 2 has a light entrance aperture 7, and a light exit aperture 8 being larger than the light entrance aperture 7. At the exit aperture 8 of the tubular reflector 2, a diffusing member, here in the form of an optically diffusing sheet 9 is provided.

The light source array 1 is arranged at the entrance aperture 7, to emit light into the tubular reflector 2. In the exemplary embodiment that is schematically illustrated in FIG. 1, the tubular reflector 2 has a polygonal cross-section, in a plane perpendicular to the optic axis 12 of the illumination system.

In order to achieve a good homogeneity of the light output by the illumination system 10, the light-source array 1 and the tubular reflector 2 should have no coinciding symmetry states. Two exemplary configurations fulfilling this condition will now be described with reference to FIGS. 2*a-b*, which are cross-sectional views as seen from the exit aperture 8 of the tubular reflector 2 along the optic axis 12 of the illumination system 10.

Figure 2A:
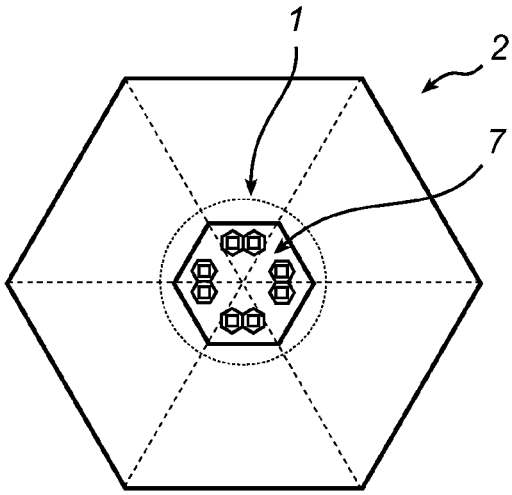
FIGS. 2*a-b* are cross-sectional views as seen along the optic axis illustrating different symmetry relations of exemplary embodiments of the present invention.

In the first exemplary configuration, which is schematically illustrated in FIG. 2*a*, the light-source array 1 exhibits one initial state and three symmetry states, that is, additional states resulting in the same configuration as the initial state. In total, the light-source array 1 thus has, as can easily be seen in FIG. 2*a*, four states with identical configurations. On the other hand, the tubular reflector 2 in FIG. 2*a* has one initial state and four symmetry states, in total five states with identical configurations.

Accordingly, the illumination system configuration that is schematically illustrated in FIG. 2*a* does not exhibit any coinciding symmetry states between the light-source array 1 and the tubular reflector 2. In particular, the ratio between the number of states with identical configurations for the tubular reflector 2 and the light-source array 1, respectively, is $5/4=1.25$, which is a non-integer.

Figure 2B:
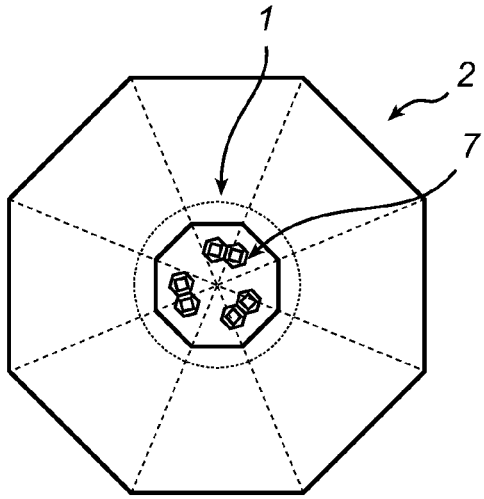

In the second exemplary configuration, which is schematically illustrated in FIG. 2*b*, the light-source array 1 exhibits one initial state and two symmetry states, that is, additional states resulting in the same configuration as the initial state. In total, the light-source array 1 thus has, as can easily be seen in FIG. 2*b*, three states with identical configurations. On the other hand, the tubular reflector 2 in FIG. 2*b* has one initial state and seven symmetry states, in total eight states with identical configurations.

Accordingly, the illumination system configuration that is schematically illustrated in FIG. 2*b* does not exhibit any coinciding symmetry states between the light-source array 1 and the tubular reflector 2. In particular, the ratio between the number of states with identical configurations for the tubular reflector 2 and the light-source array 1, respectively, is $8/3$, which is a non-integer.

In each of the exemplary configurations of the illumination system 10 shown in FIGS. 2*a-b*, the largest common divisor for the above-mentioned numbers is one.

Figure 3:
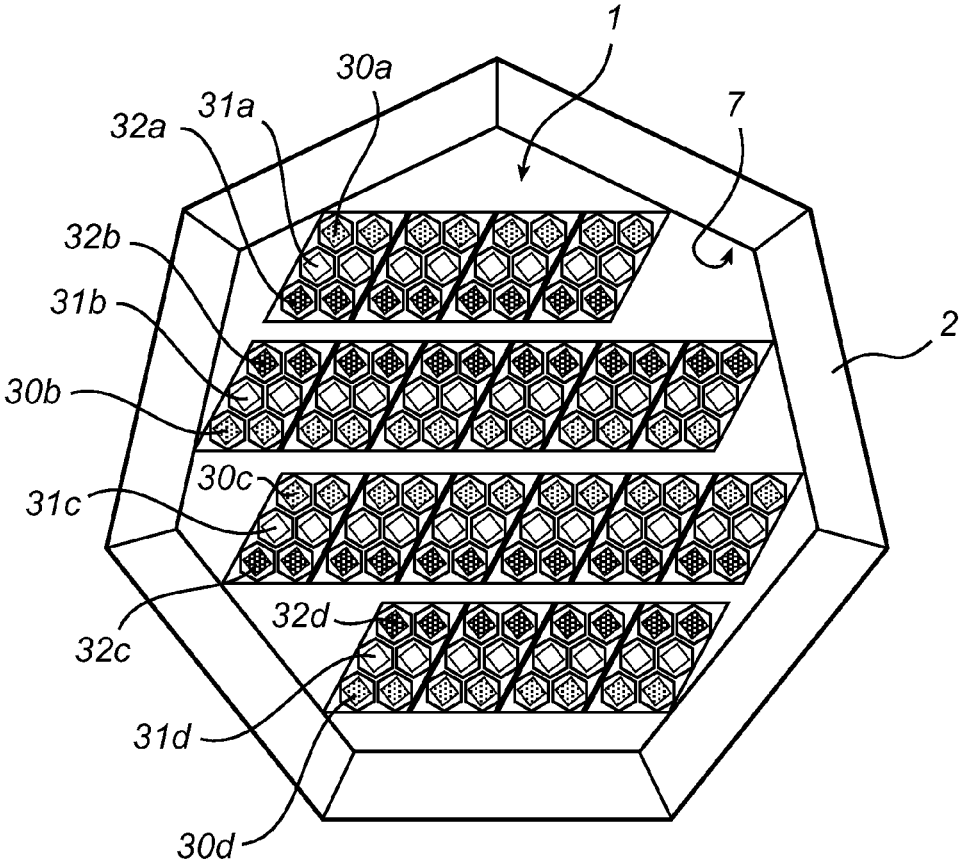
FIG. 3 schematically illustrates an exemplary light-source array configuration.

FIG. 3 schematically shows an exemplary configuration of the light-source array 1 comprising a plurality of light-sources in the form of differently colored LEDs. The light-source array comprises four sets 30*a-d* of red LEDs arranged in lines, four sets 31*a-d* of green LEDs arranged in lines and four sets 32*a-d* of blue LEDs arranged in lines.

As can be seen in FIG. 3, the light-sources 30*a-d*, 31*a-d* and 32*a-d* are arranged in such a way that the light-source array 1 exhibits rotations symmetry with two states resulting in identical light-source configurations.

To provide for the desired homogeneity of the light output by the illumination system 10 in which the light-source array 1 in FIG. 3 is comprised, the various sets 30*a-d*, 31*a-d* and 32*a-d* of light-sources are arranged such that the distance between adjacent sets of light-sources with the same color is smaller than one third of a lateral dimension of the entrance aperture 7 of the tubular reflector 2, which is schematically indicated in FIG. 3.

For the sake of simplicity of illustration, the light-source array 1 in FIG. 3 has been described as comprising LEDs of three primary colors only. As can readily be appreciated by the person skilled in the art, an improved color mixing and homogeneity can be achieved by providing LEDs configured to emit additional primary colors, such as amber, cyan, deep red and/or deep blue. Alternatively or additionally, various white light-sources may be used, such as warm white, neutral white and/or cool white. Such LEDs may be provided in additional lines, or lines may be provided in which LEDs or two or three colors are alternatingly arranged.

In the various embodiments of the illumination system according to the present invention, the light output by the illumination system generally becomes less homogeneous with increased distance from the optic axis, in a plane perpendicular to the optic axis.

Figure 4:
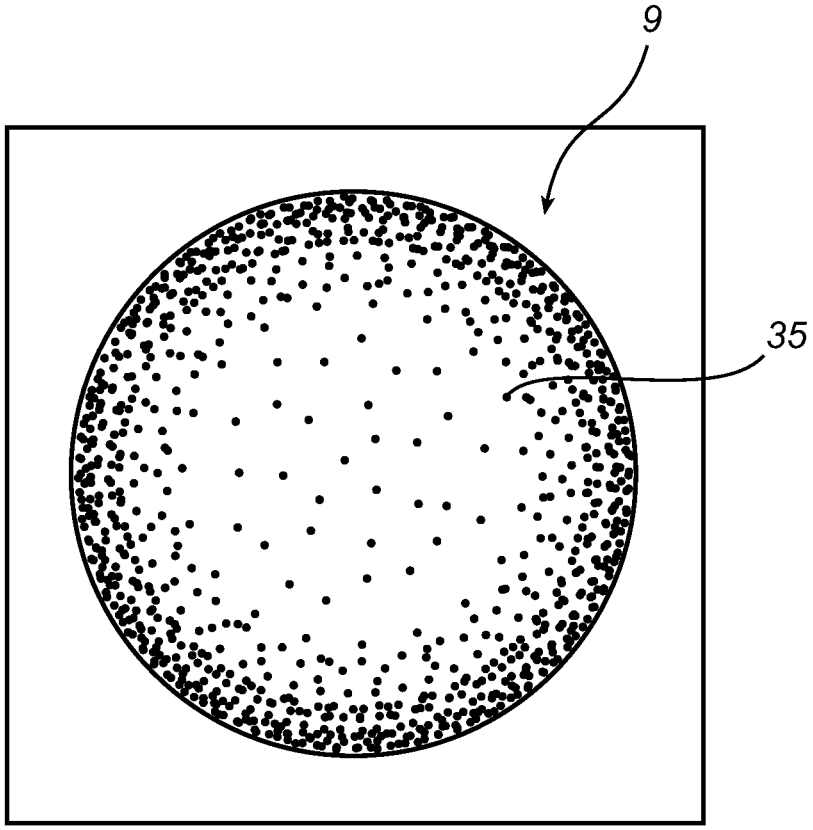
FIG. 4 schematically illustrates an exemplary configuration of the diffusing member comprised in the illumination system in FIG. 1.

To further improve the homogeneity of the light output by the illumination system, while keeping the reduction in output efficiency at a minimum, the illumination system 10 may advantageously comprise an optically diffusing member 9 arranged at the exit aperture 8 of the tubular reflector 2. Since the light is generally relatively homogeneous close to the optic axis 12, the optically diffusing member 9 has a lower diffusing power there than further away from the optic axis 12. This may, for example be achieved by providing a film comprising scattering particles 35, where the concentration of scattering particles increases with increasing distance from the optic axis 12 of the illumination system 10. This is schematically illustrated in FIG. 4. The optically diffusing member 9 may, alternatively, have a hole in the middle and thus not absorb or scatter any of the light output by the illumination system 10 close to the optic axis 12 thereof. As an alternative or complement to the scattering particles 35 that are schematically shown in FIG. 4, the diffusing capability of the optically diffusing member 9 may be accomplished using other means, such as through a holographic pattern and/or a surface relief.

For example, the light-diffusing member 9 may comprise a so-called light shaping diffuser (LSD) foil, which is, for example, available from Luminit or Fusion Optix.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

The invention claimed is:

1. An illumination system for spot illumination comprising:

a tubular reflector having a substantially polygonal cross-section with a reflective inner surface, said tubular reflector having an entrance aperture and an exit aperture being larger than the entrance aperture;

a light-source array comprising a plurality of light-sources arranged to emit light into the tubular reflector at the entrance aperture thereof; and a light-diffusing optical member arranged to diffuse light emitted by said illumination system, wherein said light-diffusing member is configured to exhibit an increasing diffusing capability with increasing distance from an optical axis of the illumination system, wherein at least one of said tubular reflector and said light-source array is configured in such a way that each ordinary non-bisecting symmetry state of said light-source array is different from an ordinary symmetry state of said tubular reflector.

2. The illumination system according to claim 1, wherein said light-diffusing optical member scatters light incident thereon, with an increasing scattering with increasing distance from said optical axis.

3. The illumination system according to claim 1, further comprising a focusing optical element arranged to focus light emitted by said illumination system.

4. The illumination system according to claim 1, wherein said tubular reflector exhibits a first number of said ordinary symmetry states having identical configurations, and said light-source array exhibits a second number of ordinary symmetry states having identical configurations, a ratio between said first number and said second number being a non-integer.

5. The illumination system according to claim 4, wherein a largest common divisor of said first number and said second number equals 1.

6. The illumination system according to claim 4, wherein said first number is a prime number greater than 2.

7. The illumination system according to claim 1, wherein at least one of said tubular reflector and said light-source array exhibits rotational symmetry with respect to said optic axis of the illumination system.

8. The illumination system according to claim 1, wherein said tubular reflector has a substantially polygonal cross-section.

9. The illumination system according to claim 1, wherein a total area occupied by the light-sources comprised in said light-source array is equal to at least 5% of an area of said entrance aperture.

10. The illumination system according to claim 1 wherein said light-source array comprises at least one set of light-sources configured to emit light of a first color and at least one set of light-sources configured to emit light of a second color different from the first color.

11. The illumination system according to claim 10, wherein said light-source array comprises at least three sets of light-sources configured to emit light of said first color and at least three sets of light-sources configured to emit light of said second color.

12. The illumination system according to claim 10, wherein a largest spacing between neighboring ones of said sets of light-sources is smaller than a third of a lateral extension width of said entrance aperture.

* * * * *